US006344098B1

(12) United States Patent
Manning et al.

(10) Patent No.: US 6,344,098 B1
(45) Date of Patent: Feb. 5, 2002

(54) HIGH STRENGTH STEAM TURBINE ROTOR AND METHODS OF FABRICATING THE ROTOR WITHOUT INCREASED STRESS CORROSION CRACKING

(75) Inventors: Michael Patrick Manning, Watervliet; Robin Carl Schwant, Pattersonville, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/733,642

(22) Filed: Dec. 8, 2000

(51) Int. Cl.[7] ..... C21D 9/08; C22C 38/44; C22C 38/46

(52) U.S. Cl. ..... 148/639; 148/640; 148/325; 148/335

(58) Field of Search ..... 148/638, 639, 148/640, 644, 325, 335

(56) References Cited

U.S. PATENT DOCUMENTS 4,179,316 A * 12/1979 Connors et al. ..... 148/639
4,486,240 A * 12/1984 Sciaky ..... 148/639
4,842,655 A * 6/1989 Porowski et al. ..... 148/644

OTHER PUBLICATIONS

"Stress Corrosion Cracking of NiCrMoV Disk Materials," Jonas, Oct. 1999.

* cited by examiner

*Primary Examiner*—Deborah Yee
(74) *Attorney, Agent, or Firm*—Nixon & Vanderhye

(57) ABSTRACT

A heat treatment process is provided that produces a monoblock, low alloy steel rotor for use in low pressure steam turbines. The process includes austenitizing the rotor at a substantially uniformly applied treatment temperature of about 840° C., quenching the rotor, and then differentially tempering the rotor at different axial locations. The rotor is tempered in a furnace divided into regions by refractory boards enabling different temperatures in each divided region to be maintained. A higher than normal strength condition is achieved in one or more axial locations along the rotor by subjecting the location(s) to a lower tempering temperature. The axial location(s) being tempered at lower temperature approximate those locations less susceptible to stress corrosion cracking whereby increased strength is provided the rotor without increasing net susceptibility to stress corrosion cracking.

21 Claims, 1 Drawing Sheet

HIGH STRENGTH STEAM TURBINE ROTOR AND METHODS OF FABRICATING THE ROTOR WITHOUT INCREASED STRESS CORROSION CRACKING

BACKGROUND OF THE INVENTION

The present invention relates to a method for selectively strengthening portions of a steam turbine rotor without increasing susceptibility to stress corrosion cracking ("SCC") along the rotor. More particularly, the invention relates to a heat treatment process enabling higher than normal strength conditions at one or more selected axial locations along the rotor without a net increase in susceptibility to stress corrosion cracking.

In order to increase the overall thermodynamic efficiency of steam turbines, the length of the airfoils extending radially from the rotor have been increased, particularly in the last stage. As the airfoil length increases, so does the local stress on the rotor. The airfoil lengths, of course, vary with axial position along the rotor. Consequently, the last stage airfoils experience the highest loading and therefore require increased rotor strength at that axial location relative to the strength of the rotor at other axial locations.

As the strength of the rotor increases, however, so too does the susceptibility of the rotor to stress corrosion cracking (SCC). SCC is an environmental phenomenon that occurs when steels and other alloys are exposed to moisture, contaminants (such as caustic ions) and applied stress. It can occur in conjunction with pitting or dissolution of the protective oxide cover. SCC is evidenced by small cracks in the metal that branch and propagate. Steam turbines are most susceptible to SCC at the point where saturation occurs and at airfoil attachment locations.

The strength of rotors has been variously increased by applying heat treatment processes uniformly along the entire rotor in order to achieve desired strength characteristics. Rotors have also been fabricated from multiple pieces with certain pieces being stronger than others. That process is inefficient as each piece must be heat treated separately. Various altered heat treatment processes have been applied to rotors but to applicants' knowledge, not for the purpose of SCC prevention. Differential heating of the rotor during austenitizing processes has been used to produce low fracture appearance transition temperature in the low pressure area and high rupture strength in the intermediate and/or high pressure areas. However, there remains a need for a rotor in which selected areas can be strengthened, e.g., to accommodate longer and heavier airfoils for increased thermodynamic efficiency without substantially increasing susceptibility to SCC.

BRIEF SUMMARY OF THE INVENTION

In accordance with a preferred embodiment of the present invention, a turbine rotor is heat-treated to provide increased strength only at one or more selected axial locations along the length of the rotor. Increasing rotor strength, however, also increases susceptibility to SCC at the locations of increased strength. The locations along the rotor at which the strength is increased are also those which traditionally experience lower SCC due to the local operating conditions. These locations occur not only at axial locations where the longer airfoils are secured, but are generally located at axial positions where the temperature and pressure conditions are at a minimum and locations that are continuously wet during operation. Thus, the increased strength at those selected locations does not increase the net susceptibility of the rotor to SCC. In other words, the susceptibility to SCC in the one or more locations of increased strength may approach the same susceptibility to SCC at rotor locations that are lower in strength and experience adverse operating conditions. This results in substantial uniform susceptibility to SCC along the length of the rotor. The SCC susceptibility is lower than it would be if the strength were increased at all positions along the rotor, including those that experience adverse operating conditions. This new rotor fabricating process enables use of longer and heavier airfoils at locations of increased strength without increased susceptibility to SCC and therefore provides rotors which reach higher thermodynamic efficiencies in low pressure steam turbines.

To accomplish this, a preferred embodiment of the present invention provides a method in which the monolithic steam turbine rotor is first austenitized at a uniform temperature, e.g., 840° C., over a period of time and subsequently quenched. The rotor is then differentially tempered. That is, the furnace used for the tempering is divided into regions which can be heated to different temperatures. A lower tempering temperature is applied in those regions which heat the rotor at the axial location(s) requiring increased strength. Thus, only those regions of the rotor requiring increased strength are heated to a lower temperature. Since those regions also coincide with the axial locations along the rotor which do not have high susceptibility to SCC, there is no net increase in susceptibility of the rotor to SCC notwithstanding the increases in strength at the one or more axial locations.

In a preferred embodiment according to the present invention, there is provided a method of fabricating a rotor for turbomachinery, comprising the steps of identifying at least one axial location along the length of the rotor requiring a higher strength condition than an axially adjacent location along the rotor and a reduced susceptibility to stress corrosion cracking in service and differentially heating the one axial location and an adjacent location along the rotor, respectively, during tempering to impart higher strength to one axial location in comparison with the strength of the adjacent location whereby a higher strength condition is achieved in one axial location without substantially increasing the susceptibility of the rotor to stress corrosion cracking.

In a further preferred embodiment according to the present invention, there is provided a method of fabricating a rotor for turbomachinery comprising the steps of identifying at least one axial location along the length of the rotor requiring higher strength than the axially adjacent location along the rotor, during an austenitizing process applied to the rotor, substantially uniformly heating the rotor along its length to obtain a rotor of substantially uniform strength throughout its length and, subsequent to austenitizing the rotor, differentially tempering the rotor to relatively increase the strength of the rotor at one axial location in comparison with the strength of the rotor at the axially adjacent location and without substantially increasing the net susceptibility of the rotor to stress corrosion cracking.

In a still further preferred embodiment according to the present invention, there is provided a process for producing a rotor for a turbine comprising the steps of (a) austenitizing the rotor in a furnace over a predetermined time period, (b) quenching the austenitized rotor and (c) tempering the rotor at different axial locations therealong to different temperatures over a predetermined time period without increasing the susceptibility of the rotor axial location tempered at a lower temperature to increased stress corrosion cracking beyond the susceptibility to stress corrosion cracking of adjacent axial locations tempered at a higher temperature.

In a still further preferred embodiment according to the present invention, there is provided a rotor for use in turbomachinery comprising a rotor body having a higher strength at a selected axial location therealong in comparison with the strength of the rotor body at an adjacent axial location, the susceptibility of the rotor body to stress corrosion cracking at the selected axial location being substantially no greater than the susceptibility of the rotor body to stress corrosion cracking at the adjacent axial locations.

DETAILED DESCRIPTION OF THE INVENTION

Figure 2:
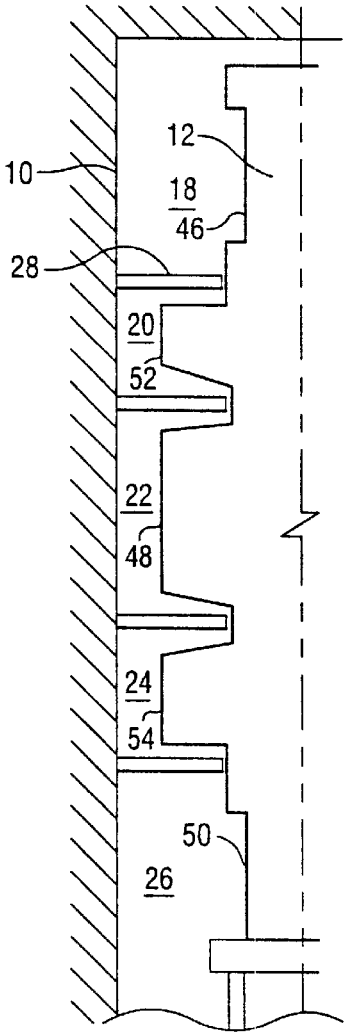
FIG. 2 schematically illustrates tempering of a double flow steam turbine rotor.
Figure 3:
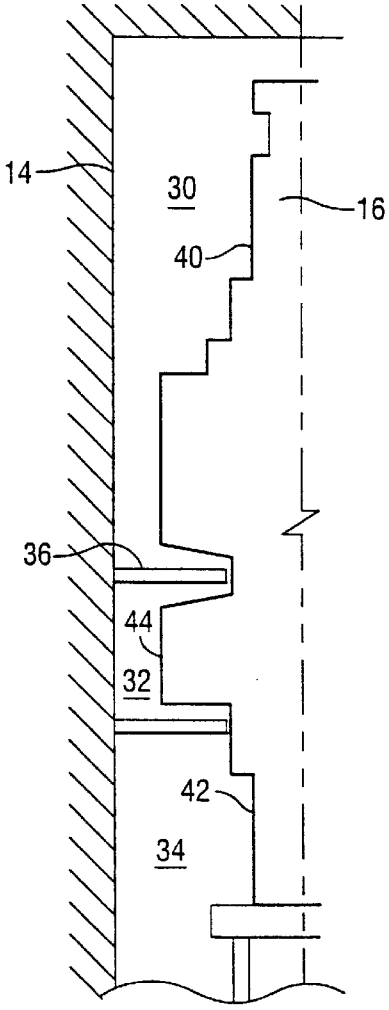
FIG. 3 schematically illustrates tempering of a single flow low pressure rotor.

FIG. 2 illustrates a preferred vertical furnace 10 having multiple zones and different firing temperatures required for heat treating a double flow turbine rotor 12. In FIG. 3, there is illustrated a similar furnace 14 for treating a single flow rotor 16. It will be appreciated that a horizontal furnace can be used in each instance. Each furnace is divided into regions. For example, the double flow turbine rotor furnace 10 is divided into five regions 18, 20, 22, 24 and 26, by refractory boards 28. Refractory boards have low heat transfer characteristics enabling the regions to maintain different furnace temperatures during tempering. The single flow turbine rotor 16 of FIG. 3 is divided into three regions 30, 32 and 34 by refractory boards 36. The single flow turbine rotor 16 has two low strength areas at differential axial locations, i.e., the rotor portions 40 and 42 opposite regions 30 and 34, respectively, with an adjacent area having a higher strength., e.g., area 44. The double flow turbine rotor has three low strength rotor areas at different axial locations, i.e., portions 46, 48 and 50, opposite regions 18, 22 and 26, respectively. Higher strength areas, e.g., areas 52 and 54 lie adjacent these lower strength areas. The lower strength areas may be considered as areas of conventional strength typical of steam turbine rotors.

As noted previously, the strength of the rotors may be increased at one or more of these and other axial locations along the rotor. This is achieved by differentially tempering the rotor subsequent to austenitizing and quenching the rotors. Particularly, the required high strength locations are initially identified. Typically, these will be the axial locations along the rotor corresponding to the axial locations of the last stage or stages. These locations also correspond to those axial locations which have reduced susceptibility to stress corrosion cracking due to the operating environment in those areas. That is, those rotor locations are continuously wet and therefore free of high concentrations of contaminants. For example, in FIG. 2, the last stages of the double flow rotor are at axial locations 52 and 54 along the rotor and are identified opposite furnace regions 20 and 24. The single flow rotor illustrated in FIG. 3 has one rotor portion 44 opposite furnace region 32 identified as requiring increased strength. As noted, because of the operating conditions of the steam turbine, these portions of the rotor have reduced susceptibility to SCC in comparison with the susceptibility to SCC of other portions along the length of the rotor.

Figure 1:
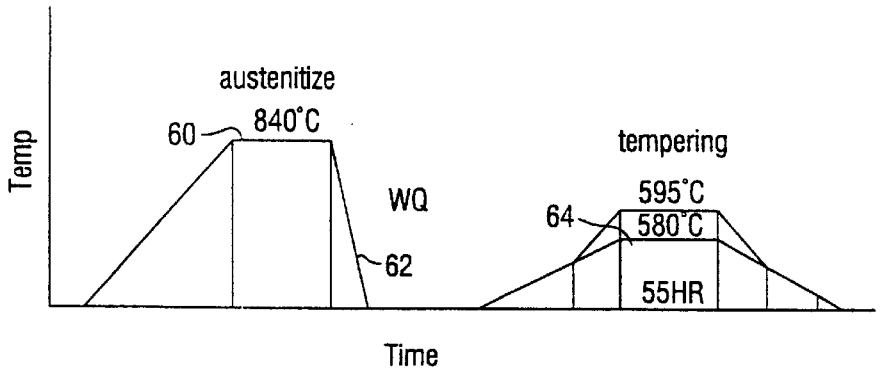
FIG. 1 illustrates austenitizing and tempering thermal cycles showing temperature versus time for quality heat treatment of a steam rotor according to the present invention.

FIG. 1 illustrates a heat treatment cycle according to a preferred embodiment of the present invention, including a unique tempering process. Specifically, FIG. 1 shows the austenitizing process 60, the quenching process 62, and the tempering process 64. In the austenitizing process 60, the low alloy steel rotor is heated to a predetermined temperature over time. For example, the entire rotor is heated and then held at a temperature of about 840° C. Austenitizing causes the rotor material to change phases and allows the material to reach a maximum strength condition after quenching. After holding the entire rotor at the austenitizing temperature for the period of time, the rotor is then quenched by submerging it in a cooling medium that drops the temperature quickly. Quenching facilitates a desirable phase transformation. The rotor then enters the tempering phase 64 to reduce the strength from the maximum level to the desired level. The rotor is again heated, e.g., in a linear fashion, to a conventional tempering temperature of about 580° C. When the rotor is nearly completely heated, the one or more selected axial locations of the rotor requiring reduced (normal) strength are heated further to a higher temperature, e.g., about 595° C. The refractory boards enable the sections of the rotor at these locations to be differentially heated. These differential rotor temperatures are maintained over a predetermined time period, e.g., 55 hours. The rotor is then cooled at an appropriate rate.

In the preferred form, the turbine rotor is made of 3.5% NiCrMoV alloy steel in a one-piece monolithic design and may also be made in a fabricated design. In the illustrated example, the turbine is a low pressure steam turbine, and the furnace is vertical in order to avoid sagging and bowing of the rotor as it is heated and cooled. In an alternative form, the rotor can be made of other alloys; the rotor can be a turbine rotor or compressor rotor and the furnace can be horizontal. It will be appreciated that the temperatures noted previously are representative and are dependent on the rotor material and other factors. Suffice to say that the present invention requires a temperature differential during heat treatment to provide different strength characteristics at different axial locations along the rotor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of fabricating a rotor for turbomachinery, comprising the steps of:

identifying at least one axial location along the length of the rotor requiring a higher strength condition than an axially adjacent location along the rotor and a reduced susceptibility to stress corrosion cracking in service; and differentially heating the one axial location and an adjacent location along the rotor, respectively, during tempering to impart higher strength to said one axial location in comparison with the strength of the adjacent location whereby a higher strength condition is achieved in said one axial location without substantially increasing the susceptibility of the rotor to stress corrosion cracking.

2. A method according to claim 1 including, during an austenitizing process prior to tempering, heating the rotor substantially uniformly along its length and subsequently, prior to tempering, quenching the rotor.

3. A method according to claim 1 wherein the one axial location comprises at least one of last stages of a turbine rotor.

4. A method according to claim 3 wherein the differential heating step includes heating the one axial location of the rotor to a temperature below the temperature of the rotor at said axially adjacent location.

5. A method according to claim 1 including performing the step of differentially heating the rotor while the rotor is in a substantially vertical position.

6. A method according to claim 1 wherein the step of differentially heating is performed in a furnace, and dividing the furnace into regions axially spaced and thermally insulated from one another.

7. A method according to claim 1 wherein the rotor is formed of 3.5% NiCrMoV steel, and including the step of first austenitizing the rotor at a substantially uniform temperature along its length, quenching the austenitized rotor and subsequently differentially heating the rotor to impart a higher strength to said one axial location than said adjacent location.

8. A method according to claim 7 including austenitizing the rotor at a temperature of about 840° C. and differentially tempering the rotor by heating the one axial location of the rotor to a temperature lower than the temperature of the rotor at said adjacent location.

9. A method according to claim 8 including tempering the rotor by applying heat to a temperature at said adjacent location of about 595° C. and heating the one axial location to a temperature of about 580° C.

10. A method of fabricating a rotor for turbomachinery comprising the steps of:

identifying at least one axial location along the length of the rotor requiring higher strength than the axially adjacent location along the rotor;

during an austenitizing process applied to the rotor, substantially uniformly heating the rotor along its length to obtain a rotor of substantially uniform strength throughout its length; and subsequent to austenitizing the rotor, differentially tempering the rotor to achieve higher strength of the rotor at said one axial location in comparison with the strength of the rotor at said axially adjacent location and without substantially increasing the net susceptibility of the rotor to stress corrosion cracking.

11. A method according to claim 10 wherein the turbomachinery includes a turbine and the one axial location comprises a last stage of the turbine rotor.

12. A method according to claim 10 wherein the differential heating step includes heating the one axial location of the rotor to a temperature lower than the temperature of the rotor at said axially adjacent location.

13. A method according to claim 10 wherein the step of differentially heating is performed in a furnace, and dividing the furnace into regions axially spaced and thermally insulated from one another.

14. A method according to claim 10 including austenitizing the rotor at a temperature of about 840° C. and differentially tempering the rotor by heating the one axial location of the rotor to a temperature lower than the temperature of the rotor at said axially adjacent location.

15. A method according to claim 14 including tempering the rotor by applying heat to a temperature at said axially adjacent location of about 595° C. and heating the rotor of said one axial location to a temperature of about 580° C.

16. A process for producing a rotor for a turbine comprising the steps of:

(a) austenitizing the rotor in a furnace over a predetermined time period;

(b) quenching the austenitized rotor; and (c) tempering the rotor at different axial locations therealong to different temperatures over a predetermined time period without increasing the susceptibility of the rotor axial location tempered at a lower temperature to increased stress corrosion cracking beyond the susceptibility to stress corrosion cracking of adjacent axial locations tempered at a higher temperature.

17. A rotor for use in turbomachinery turbine comprising:

a rotor body having a higher strength at a selected axial location therealong in comparison with the strength of the rotor body at an adjacent axial location, the susceptibility of the rotor body to stress corrosion cracking at said selected axial location being substantially no greater than the susceptibility of the rotor body to stress corrosion cracking at said adjacent axial locations.

18. A rotor as claimed in claim 17, wherein the rotor body is comprised of 3.5% NiCrMoV alloy steel.

19. A rotor as claimed in claim 17, wherein the rotor body is comprised of CrMoV alloy steel.

20. A rotor as claimed in claim 17, wherein the rotor body is monolithic.

21. A rotor as claimed in claim 17 wherein the rotor body is fabricated.

* * * * *